US009657376B2

(12) United States Patent
Kim et al.

(10) Patent No.: US 9,657,376 B2
(45) Date of Patent: May 23, 2017

(54) ALUMINUM ALLOY AND PRODUCTION METHOD THEREOF

(75) Inventors: Shae-Kwang Kim, Seoul (KR); Young-Ok Yoon, Incheon (KR); Jeong-Ho Seo, Seoul (KR)

(73) Assignee: KOREA INSTITUTE OF INDUSTRIAL TECHNOLOGY, Cheonan-si, Chungcheongnam-do (KR)

( * ) Notice: Subject to any disclaimer, the term of this patent is extended or adjusted under 35 U.S.C. 154(b) by 528 days.

(21) Appl. No.: 14/119,084

(22) PCT Filed: May 16, 2012

(86) PCT No.: PCT/KR2012/003843

§ 371 (c)(1),
(2), (4) Date: Nov. 20, 2013

(87) PCT Pub. No.: WO2012/161459

PCT Pub. Date: Nov. 29, 2012

(65) Prior Publication Data

US 2014/0086790 A1 Mar. 27, 2014

(30) Foreign Application Priority Data

May 20, 2011 (KR) ..... 10-2011-0048189

(51) Int. Cl.

| | |
|---|---|
| ***C22C 21/08*** | (2006.01) |
| ***C22F 1/047*** | (2006.01) |
| ***C22C 1/02*** | (2006.01) |
| ***C22C 1/03*** | (2006.01) |
| ***C22C 1/06*** | (2006.01) |

(Continued)

(52) U.S. Cl.

CPC ..... *C22C 21/08* (2013.01); *C22C 1/026* (2013.01); *C22C 1/03* (2013.01); *C22C 1/06* (2013.01); *C22C 21/00* (2013.01); *C22C 23/00* (2013.01); *B22D 21/04* (2013.01)

(58) Field of Classification Search

CPC ..... B22C 21/04; C22C 21/06; C22C 21/08; C22F 1/043; C22F 1/047; C22F 1/05

See application file for complete search history.

(56) References Cited

U.S. PATENT DOCUMENTS 5,178,686 A * 1/1993 Schmid ..... C22C 21/08 148/439

2007/0144630 A1 6/2007 Anami et al.

FOREIGN PATENT DOCUMENTS

JP 11-323456 A 11/1999

KR 20110031629 A 3/2011

OTHER PUBLICATIONS

Kondoh et al., "New Process to Fabricate Magnesium Composites Using SiO2 Glass Scraps", Materials Transactions, vol. 44, No. 12, (2003), pp. 2468-2474.*

(Continued)

*Primary Examiner* — Lois Zheng

(74) *Attorney, Agent, or Firm* — Ladas & Parry LLP

(57) ABSTRACT

Provided are an aluminum alloy improving mechanical characteristics by allowing a magnesium-silicon compound to be distributed in an aluminum matrix without performing a heat treatment, and a production method thereof. In accordance with an aspect of the present disclosure, there is provided a method of producing an aluminum alloy, including: melting a magnesium mother alloy including a magnesium-silicon compound, and aluminum to form a molten metal; and casting the molten metal.

10 Claims, 6 Drawing Sheets

(51) Int. Cl.

| | |
|---|---|
| ***C22C 21/00*** | (2006.01) |
| ***C22C 23/00*** | (2006.01) |
| *B22C 21/04* | (2006.01) |
| *B22D 21/04* | (2006.01) |

(56) References Cited

OTHER PUBLICATIONS

International Search Report mailed Dec. 3, 2012; PCT/KR2012/003843

* cited by examiner (a)

(b)

ALUMINUM ALLOY AND PRODUCTION METHOD THEREOF

BACKGROUND

The present disclosure relates to an aluminum alloy and a method of producing the same, and more particularly, to an aluminum alloy including magnesium and silicon as alloy elements and a method of producing the same.

An aluminum-magnesium-silicon (Mg—Al—Si) alloy in which magnesium (Mg) and silicon (Si) are added to aluminum (Al) corresponds to the 6000 series on classifications derived from the US aluminum association, and is used as a wrought material having excellent corrosion resistance and formability. A 6063 alloy that is a representative Mg—Al—Si alloy has excellent extrudability and surface treatment characteristic and thus is much used as a construction material, and a 6061 alloy in which more magnesium and silicon are added than the 6063 alloy has a higher mechanical strength than the 6063 alloy, and thus is used in a crane, a vehicle bump, etc. requiring lightweight and high strength.

In such an Mg—Al—Si alloy, an intermetallic compound of $Mg_2Si$ is precipitated and distributed in an Al matrix by heat treatment and the strength is increased due to the $Mg_2Si$ precipitate phase.

The phase diagram of Al—$Mg_2Si$ exhibits a solid solubility of $Mg_2Si$ to Al that approaches 1.85% at 595° C. but sharply decreases as the temperature drops and has a value close to about zero (0) at room temperature. Therefore, when the temperature drops in a state that $Mg_2Si$ is solid-solutioned, a large amount of $Mg_2Si$ is precipitated in a matrix due to a difference in solid solubility according to the temperature, and mechanical properties of aluminum alloys are improved by such $Mg_2Si$. In detail, an alloy that is produced by adding magnesium and silicon to aluminum is solution-treated at 515-550° C., then cooled with water, and then aged at 170-180° C. to precipitate $Mg_2Si$. Thus, in the case of a related art Mg—Al—Si alloy, a series of heat treatment processes should be necessarily performed in order to precipitate $Mg_2Si$.

SUMMARY

The present disclosure provides an aluminum alloy and a method of producing the same that can improve mechanical characteristics by distributing an intermetallic compound (hereinafter, magnesium-silicon compound) including magnesium and silicon in an aluminum matrix without a heat treatment. The above subject matter is only exemplary, and the scope of the present disclosure is not limited by the subject matter.

In accordance with an exemplary embodiment, there is provided a method of producing an aluminum alloy, including: melting a magnesium mother alloy including a magnesium-silicon compound, and aluminum to form a molten metal; and casting the molten metal.

The aluminum may be pure aluminum or an aluminum alloy.

The magnesium mother alloy may be produced by adding a silicon-based additive to a mother material that is pure magnesium or a magnesium mother material.

The magnesium mother alloy may be added in a range of 0.0001 wt % to 30 wt %.

The magnesium-silicon compound may be produced by a reaction between magnesium and silicon separated from the silicon-based additive.

The producing of the magnesium mother alloy may include: melting pure magnesium or a magnesium alloy to form a magnesium molten metal; and adding a silicon-based additive to the magnesium molten metal.

The producing of the magnesium mother ally may further include, after adding of the silicon-based additive, exhausting the silicon-based additive such that the silicon-based additive does not remain in the magnesium mother alloy; and performing a reaction such that silicon produced as a result of the exhausting does not substantially remain in the magnesium mother alloy.

The silicon-based additive may be added to be uniformly dispersed on a surface of the magnesium molten metal.

The silicon-based additive may be added to a range that the silicon-based additive completely reacts and thus does not remain in the magnesium mother alloy. For example, the silicon-based additive may be added in a range of 0.001 wt % to 30 wt %.

After the adding of the silicon-based additive, an upper layer portion of the magnesium molten metal may be stirred. The stirring may be performed at an upper layer portion from a surface of the magnesium molten metal to a point which is not more than 20% of a total depth of the magnesium molten metal.

The silicon-based additive may include silicon dioxide ($SiO_2$).

The magnesium-silicon compound may include $Mg_2Si$.

In accordance with another exemplary embodiment, there is provided an aluminum alloy including: an aluminum matrix; and a magnesium-silicon compound existing in the aluminum matrix, wherein the magnesium-silicon compound is produced by a reaction between silicon decomposed from the silicon-based additive added to the magnesium molten metal, and magnesium.

The aluminum matrix may be one in which magnesium is solid-solutioned.

The silicon-based additive may include silicon dioxide ($SiO_2$).

The magnesium-silicon compound may include $Mg_2Si$.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, the present invention will be described in detail by explaining preferred embodiments of the invention with reference to the attached drawings. The present disclosure may, however, be embodied in many different forms and should not be construed as being limited to the embodiments set forth herein; rather, these embodiments are provided so that this disclosure will be thorough and complete, and will fully convey the concept of the invention to those skilled in the art. Further, the present invention is only defined by scopes of claims.

An aluminum alloy according to the present disclosure is produced by adding a silicon-based additive to pure magnesium or a magnesium alloy to produce a mother alloy, and then adding the produced mother alloy to pure aluminum or an aluminum alloy. Here, the mother ally indicates an alloy which is produced for addition in a molten metal provided in a subsequent operation, and for discrimination, a resultant material which is produced by adding the mother alloy is referred to as an alloy.

Also, the term "magnesium mother alloy" used in the description and claims indicates all those in which pure magnesium or a magnesium alloy is used as a mother material.

Figure 1:
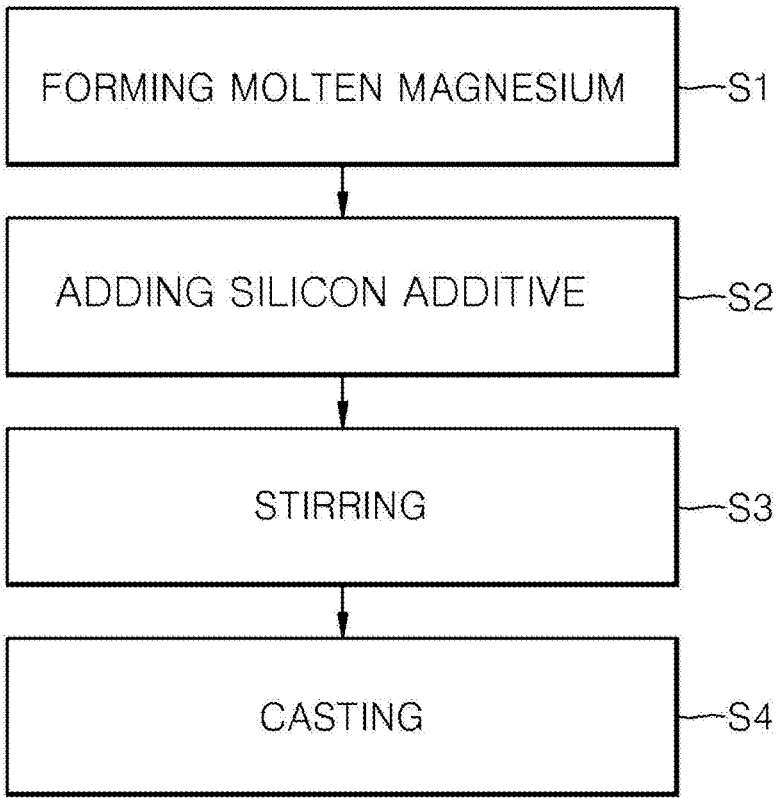
FIG. 1 is a flow diagram showing an embodiment of a method of producing a magnesium mother alloy which is added to an aluminum molten metal in producing an aluminum alloy.

FIG. 1 is a flow diagram showing an embodiment of a method of producing a magnesium mother alloy. Referring to FIG. 1, the method of producing a magnesium mother alloy includes forming a magnesium molten metal (S1), adding a silicon-based additive (S2), and casting (S4).

In the forming (S1) of the magnesium molten metal, pure magnesium or a magnesium alloy is put in a crucible and heated to form a magnesium molten metal. Here, the heating temperature may be in a range of 400° C. to 800° C.

Although in the case of pure magnesium, a molten metal is formed at 600° C. or higher, in the case of the magnesium alloy, a molten metal may be formed at a temperature not higher than 600° C., for example, at a temperature of 400° C. or higher, due to a melting point drop that may appear by alloying.

Here, when the heating temperature is less than 400° C., it is difficult to form a magnesium molten metal, and when the heating temperature exceeds 800° C., sublimation in the magnesium molten metal occurs or there is a danger of ignition.

The magnesium alloy used in the forming (S1) of the magnesium molten metal may be any one selected from the group consisting of AZ91D, AM20, AM30, AM50, AM60, AZ31, AS41, AS31, AS21X, AE42, AE44, AX51, AX52, AJ50X, AJ52X, AJ62X, MRI153, MRI230, AM-HP2, Mg—Al, Mg—Al—Re, Mg—Al—Sn, Mg—Zn—Sn, Mg—Si, Mg—Zn—Y, and equivalents thereof, but the present disclosure is not limited thereto. Any magnesium ally will be possible if it can be generally used in industry fields.

Meanwhile, in order to prevent the magnesium molten metal from igniting, a protection gas may be provided to the magnesium molten metal. The protection gas includes $SF_6$, $SO_2$, $CO_2$, HFC-134a, Novec™ 612, inert gases and equivalents thereof, and mixture gases thereof, and may suppress ignition of the molten metal.

In the adding (S2) of the silicon-based additive, a silicon-based additive is added to the magnesium molten metal. At this time, the silicon-based additive may be added in order not to be mixedly introduced into the magnesium molten metal but to be uniformly distributed in a surface of the magnesium molten metal.

The silicon-based additive thus added may be subject to exhausting the silicon-based additive such that the silicon-based additive is sufficiently exhausted and does not substantially remain in the magnesium mother alloy which is produced by casting the molten metal in a subsequent process, and reacting silicon produced as a result of the exhausting such that the silicon does not substantially remain in the magnesium mother alloy.

At this time, the silicon decomposed from the added silicon-based additive may react with magnesium in the magnesium molten metal to a magnesium-silicon compound (in which magnesium and silicon are chemically bonded to each other). The magnesium-silicon compound may include $Mg_2Si$.

Such a silicon-based additive may be a compound in which silicon as a constituting element is chemically bonded to another element, for example, silicon dioxide ($SiO_2$). When silicon oxide is added as the silicon-based additive, silicon oxide is decomposed into silicon and oxygen, and the oxygen is charged in a gas state to the atmosphere from the magnesium molten metal or is floated in an upper portion of the molten metal in the form of dross or sludge. The decomposed silicon may react with magnesium to form the above-described magnesium-silicon compound.

The silicon-based additive is advantageous for enhancement of reactivity when the surface area thereof is as wide as possible, and thus is added in the form of powder. However, the present disclosure is not limited thereto, and the silicon-based additive may be added in the form of pellet or bulk in which powder particles are agglomerated so as to prevent powder from scattering.

The size of the added silicon-based additive may be in a range of 0.1 μm to 500 μm, and more strictly, in a range of 0.1 μm to 200 μm.

When the size of the silicon-based additive is less than 0.1 μm, the size is so fine that additive particles are scattered by sublimated magnesium or hot wind and thus have a difficulty in introducing the same in the crucible. Also, since the additive particles are agglomerated to form an agglomerate, they are not easily mixed with the liquid phase molten metal. Such an agglomerate is not preferred in that it decreases the surface area for a reaction.

When the size of the silicon-based additive exceeds 500 μm, the surface area for a reaction decreases, and further the silicon-based additive may not react with the magnesium molten metal. In order to more enhance the reactivity, the size of the silicon-based additive may be adjusted to be not more than 200 μm.

At this time, the silicon-based additive may be added to a range that the silicon-based additive reacts completely and thus does not remain in the magnesium mother ally, for example, in a range of 0.001 wt % to 30 wt %, more strictly, in a range of 0.01 wt % to 15 wt %.

When the added amount of the silicon-based additive is less than 0.001 wt %, mechanical characteristic of the magnesium alloy by addition of the silicon-based additive are slightly improved or almost not improved. Also, when the added amount of the silicon-based additive exceeds 30 wt %, the original characteristics of magnesium may not appear.

The silicon-based additive may be added at one time by a necessary amount, or may be added in multi-stage with a constant time difference by dividing the necessary amount into proper amounts. When the added silicon-based additive is a powder having fine particles, the agglomeration possibility of the powder may be lowered and the reaction of the silicon-based additive may be promoted by adding the powder silicon oxide in multi-stage with a constant time difference.

In order to more promote the reaction of the added silicon-based additive, stirring (S3) of the magnesium molten metal may be performed. The stirring may start at the same time with the addition of the silicon-based additive, or may start after the added silicon-based additive is heated in the molten metal to a predetermined temperature. Also, the stirring may be performed at an upper layer portion of the magnesium molten metal, for example, at a region from a surface of the magnesium molten metal to a point which is not more than 20% of a total depth of the magnesium molten metal to thus more promote the reaction of the silicon-based additive.

While the stirring time may have a difference depending on the temperature of the molten metal and the state of added powder, the stirring may be performed sufficiently until the added silicon-based additive is completely exhausted in the molten metal and further silicon decomposed from the silicon-based additive substantially completely reacts.

When the stirring (S3) of the magnesium molten metal is completed, casting (S4) in which the magnesium molten metal is injected into a mold to solidify the injected molten metal is performed to produce a magnesium mother alloy.

In the casting (S4), the temperature of the mold may be in a range of room temperature (e.g., 25° C.) to 400° C. Also, after the mold is cooled to room temperature, the mother alloy may be separated from the mold, but when the solidification of the mother alloy is completed, the mother alloy may be separated from the mold even at a temperature prior to room temperature.

Here, the mold may be any selected from the group consisting of a metal mold, a ceramic mold, a graphite mold, and equivalents. Also, examples of the casting may include a sand casting, a die casting, a gravity casting, a continuous casting, a low pressure casting, a squeeze casting, a lost wax casting, a thixo casting, and the like.

The gravity casting indicates a method in which a molten alloy is injected into a mold using gravity, and the low pressure casting may indicate a method in which a pressure is applied to a molten metal surface of a molten alloy using a gas to inject the molten metal into a mold. The thixo casting is a casting technique in a semi-molten state, and is a method in which the advantages of typical casting and forging are fused. However, the present disclosure does not limit the type of the mold and the method of the casting.

A magnesium-silicon compound produced during the production of the mother alloy may exist in a matrix of the magnesium mother alloy thus produced. As described above, the magnesium-silicon compound may be one formed by a reaction between silicon decomposed from the silicon-based additive added to the magnesium molten metal and magnesium.

Figure 2:
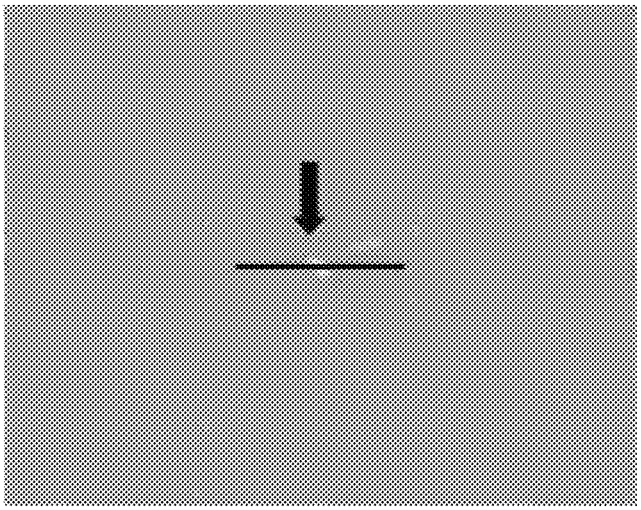
FIGS. 2 and 3 show analysis results of form and components of a magnesium-silicon compound in a magnesium mother alloy.
Figure 2:
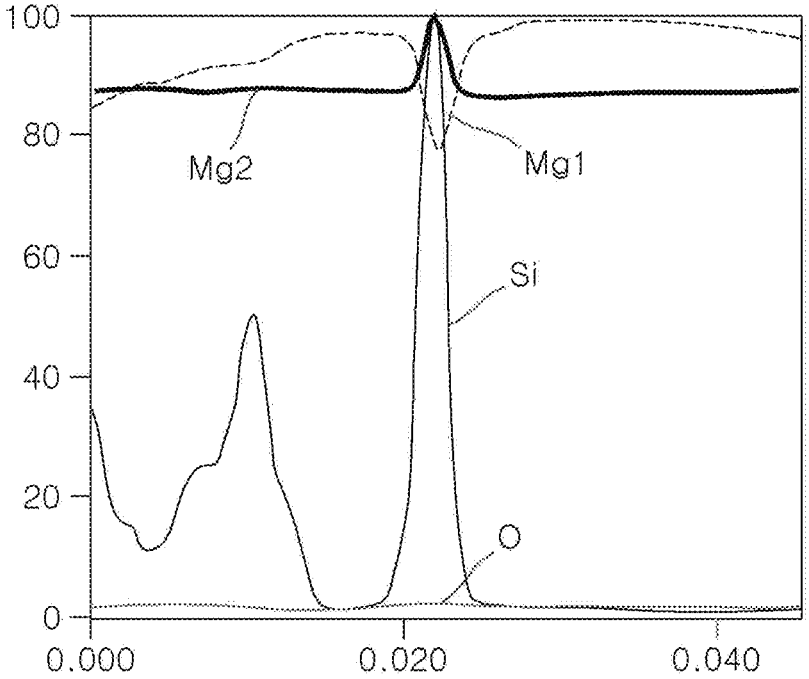

FIG. 2A shows a result when grain phases distributed in the matrix of the magnesium mother ally produced by the above-described method are observed by a scanning electron microscope (SEM), and FIGS. and FIG. 2B shows a result when components are analyzed along the straight line shown in FIG. 2A.

Referring to FIGS. 2A and 2B, silicon component (Si of FIG. 2B) and magnesium component (Mg1 of FIG. 2B) were detected in a grain phase and oxygen (O of FIG. 2B) was not detected. At this time, it can be known that the grain phase is a magnesium-silicon compound including magnesium and silicon from the fact that the detection concentration of the detected magnesium (Mg1 of FIG. 2B) is different from the detection concentration of matrix magnesium (Mg2 of FIG. 2B).

Figure 3:
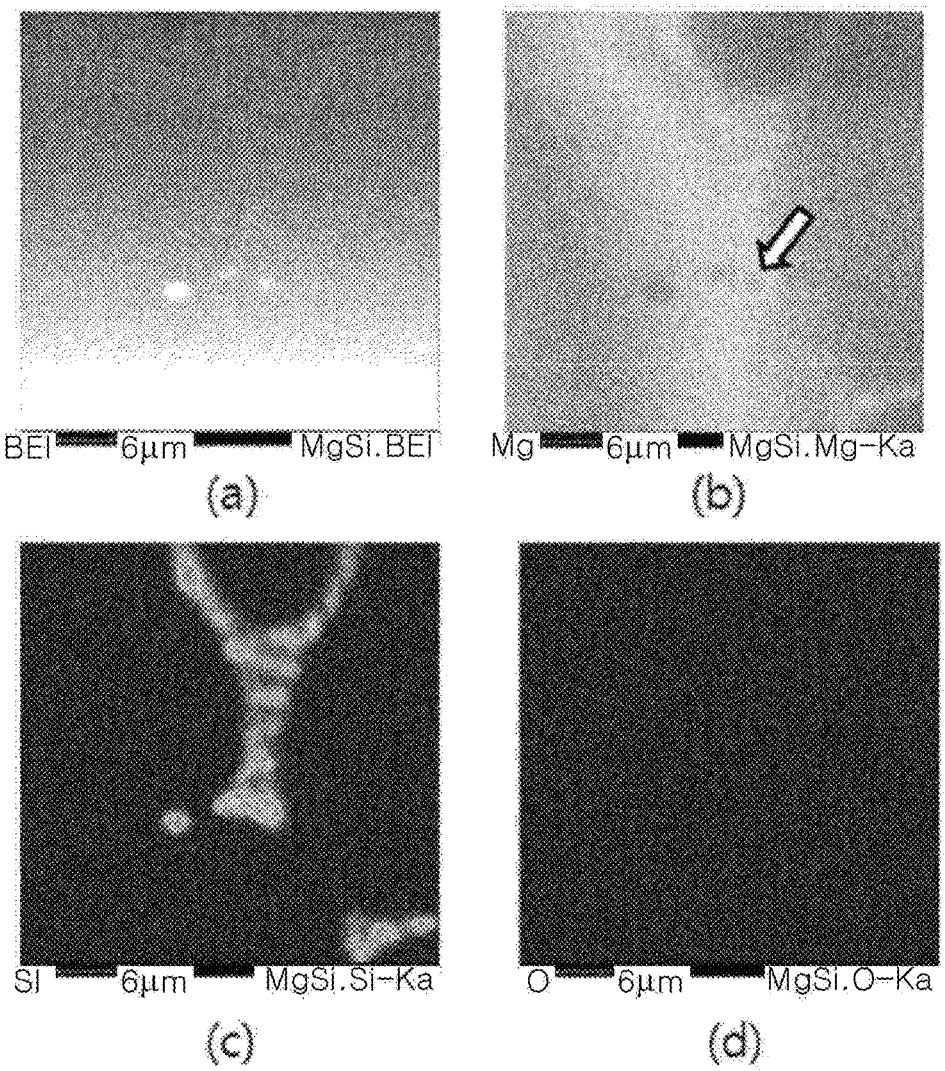

FIG. 3A shows a microstructure of a magnesium mother alloy observed using a back scattering electron, and FIGS. 3B through 3D are mapping results by EPMA, and show distributions of aluminum, silicon, and oxygen, respectively.

Referring to FIG. 3A, it can be known that a phase discriminated from the matrix is formed at a boundary of the magnesium matrix. It is shown that a detection signal of magnesium from such a phase is lower than a detection signal of a magnesium matrix of another region (see arrow of FIG. 3B) and a detection signal of silicon is high (see white portion of FIG. 3C). On the other hand, oxygen was not detected as shown in FIG. 3D.

From this result, it can be known that the phase is a compound including magnesium and silicon. That is, it can be known that the magnesium-silicon compounds which are produced by a reaction between silicon separated from the silicon-based additive of the magnesium mother alloy produced by the above-described method, and magnesium are distributed. The magnesium-silicon compound may be $Mg_2Si$ that is an intermetallic compound exhibited in the Mg—Si phase diagram.

The magnesium mother alloy thus produced may be again added to the aluminum molten metal when an aluminum alloy is cast. At this time, as described above, the magnesium mother alloy includes a magnesium-silicon compound formed by a reaction between silicon supplied from the silicon-based additive added in the course of casting, and magnesium. Such a magnesium-silicon compound may have a remarkably higher melting point than aluminum. For example, the melting point of $Mg_2Si$ is 1,120° C., which is remarkably higher than the melting point (658° C.) of aluminum.

Therefore, when the magnesium mother alloy including such a magnesium-silicon compound having a high melting point is added to the molten metal, the magnesium-silicon compound may not be melted but be maintained in the molten metal. Thus, the magnesium-silicon compounds may be distributed in the matrix of the aluminum alloy produced by casting such an aluminum molten metal. In this case, an effect that the magnesium-silicon compounds are distributed in the matrix of the aluminum alloy without heat-treating the aluminum alloy can be obtained.

Hereinafter, a method of producing an aluminum alloy in accordance with an exemplary embodiment will be described.

A method of producing an aluminum alloy in accordance with an exemplary embodiment includes providing a magnesium mother alloy including a magnesium-silicon compound, and aluminum, forming a molten metal in which the magnesium mother alloy and the aluminum are melted, and casting the molten metal.

At this time, aluminum is first melted to form an aluminum molten metal, and a magnesium mother alloy including a magnesium-silicon compound is added to the aluminum molten metal and melted to form a molten metal in which the magnesium mother alloy and the aluminum are melted.

In another method, the molten metal may be formed by introducing aluminum and the magnesium mother alloy together in a melting apparatus such as a crucible, and heating the melting apparatus to melt the aluminum and the magnesium mother alloy.

Figure 4:
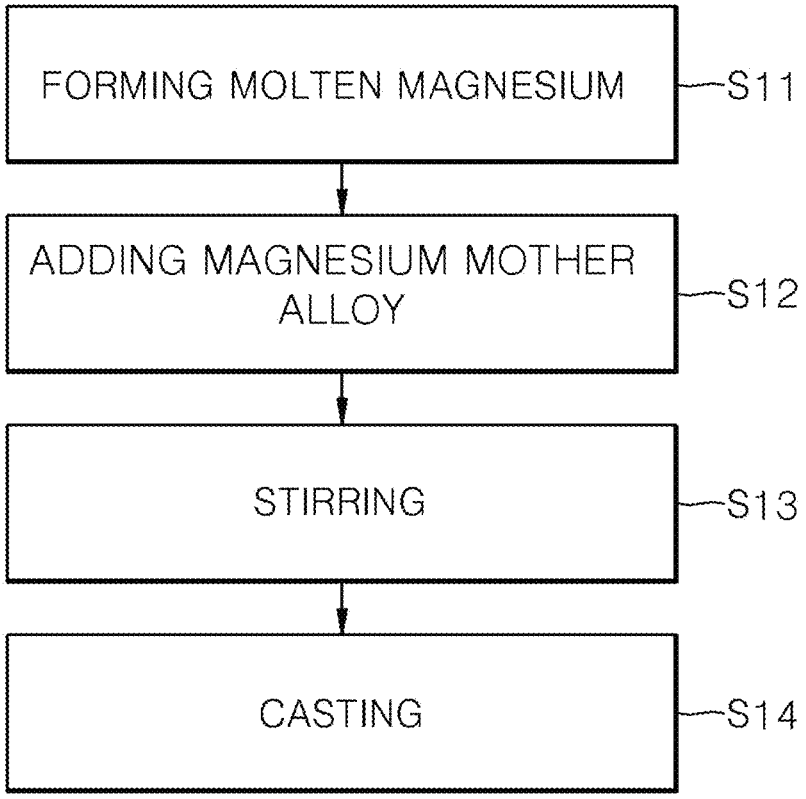
FIG. 4 is flow diagram showing an embodiment of a method of producing an aluminum alloy according to the present disclosure.

FIG. 4 is a flow diagram showing a method of producing an aluminum alloy in which an aluminum molten metal is first formed, and then the magnesium mother alloy produced by the above-described method is added and melted.

Referring to FIG. 4, the method of producing the aluminum alloy includes forming (S11) of an aluminum molten metal, adding (S12) of a magnesium mother alloy, stirring (S13), and casting (S14).

First, in the forming (S11) of the aluminum molten metal, aluminum is put in a crucible and then is heated in a temperature range of 600° C. to 900° C. to form an aluminum molten metal.

The aluminum in the forming (S11) of the aluminum molten metal indicates pure aluminum or an aluminum alloy. The aluminum alloy may be any one selected from the group consisting of 1000 series, 2000 series, 3000 series, 4000 series, 5000 series, 6000 series, 7000 series and 8000 series plastic working aluminum alloys, or 100 series, 200 series, 300 series, 400 series, 500 series, and 700 series casting aluminum alloys.

Next, in the addition (S12) of the magnesium mother alloy, the magnesium mother alloy produced by the above-described method is added to the aluminum molten metal.

The magnesium mother alloy in the adding (S12) of the magnesium mother alloy may be added in a range of 0.0001 wt % to 30 wt %. When the added amount of the magnesium mother alloy is less than 0.0001 wt %, an effect according to the adding of the magnesium mother alloy may be small. Also, when the added amount of the magnesium mother alloy exceeds 30 wt %, the original characteristics of the aluminum alloy may not appear. The magnesium mother alloy may be added in the form of an ingot, but the present disclosure is not limited thereto, and the magnesium mother alloy may have other forms such as powder form, granule form, and the like.

When the magnesium mother alloy is added, the magnesium-silicon compound contained in the magnesium mother alloy is also provided to the aluminum molten metal.

At this time, in order to prevent oxidation of the magnesium mother alloy, a small amount of protection gas may be additively provided. The protection gas includes $SF_6$, $SO_2$, $CO_2$, HFC-134a, Novec™ 612, inert gases and equivalents thereof, and mixture gases thereof, and may suppress oxidation of the magnesium mother alloy.

At this time, the stirring (S13) may be performed in order to sufficiently mix the magnesium mother alloy in the aluminum molten metal.

Next, when it is determined that the magnesium mother alloy is sufficiently mixed, casting (S14) in which the aluminum molten metal is poured into a mold and solidified is performed.

In the casting (S14), the temperature of the mold may be in a range of room temperature (e.g., 25° C.) to 400° C. Also, after the mold is cooled to room temperature, the aluminum alloy may be separated from the mold, but when the solidification of the aluminum alloy is completed, the aluminum alloy may be separated from the mold even at a temperature prior to room temperature.

Since the casting method has been described in detail in the explanation of the method of producing the magnesium mother alloy, detailed description thereof will be omitted.

The aluminum alloy produced according to the casting method of the present disclosure includes the magnesium-silicon compound, for example, $Mg_2Si$ which is distributed in the aluminum matrix although a separate heat treatment is not performed with respect to the aluminum matrix in the cast state. That is, the magnesium-silicon compound which is included in the magnesium mother alloy added to the aluminum molten metal is maintained in the molten metal and then is formed as a separate phase in the aluminum matrix in the casting of the aluminum alloy.

At this time, the aluminum matrix may have a plurality of regions discriminated by a boundary, and the magnesium-silicon compound may exist in the boundary or within the plurality of regions. The plurality of regions discriminated from each other may be typically a plurality of crystal grains discriminated by a grain boundary, and in another example, may be a plurality of phase regions defined by a phase boundary of two or more different phases.

Since the grain boundary or phase boundary is an open structure compared to the crystal grain or the inside of the phase region and has relatively high energy, the magnesium-silicon compound may be distributed in such a grain boundary or phase boundary.

In the case where the magnesium-silicon compound is distributed in the grain boundary or phase boundary of the aluminum alloy, the magnesium-silicon compound acts as a barrier blocking the grain boundary or phase boundary from moving to suppress movement of the grain boundary or phase boundary, thereby capable of decreasing the average size of the grain boundary or phase boundary.

Or, the magnesium-silicon compound may provide a nucleation site while a phase transition of the aluminum alloy from liquid phase to solid phase occurs. That is, the phase transition of the magnesium-silicon compound from liquid phase to solid phase during the solidification of the aluminum alloy occurs in aspects of nucleation and growth, and at this time, since the magnesium-silicon compound itself functions as a heterogeneous nucleation site, nucleation for a phase transition of the magnesium-silicon compound from liquid phase to solid phase at a grain boundary occurs preferentially. The nucleated solid phase is formed around the magnesium-silicon compound and grows.

In the case where the magnesium-silicon compound particles are dispersively distributed, solid phases grown at boundaries of the respective magnesium-silicon compound particles meet with each other to form a boundary, and the boundary thus formed may form a grain boundary or phase boundary. Therefore, if the magnesium-silicon compound functions as a nucleation site, the magnesium-silicon compound exists within the crystal grain or the phase region, and the crystal grain or the phase region can show a fineness effect, compared to a case where the magnesium-silicon compound does not exist.

Thus, the aluminum alloy according to the present disclosure may have a finer and smaller crystal grain or phase size in average than an aluminum alloy in which the magnesium-silicon compound does not exist. The fineness of the crystal grain or phase region due to the magnesium-silicon compound may have an improvement effect in mechanical characteristics such as strength, toughness, and elongation of the aluminum alloy.

Meanwhile, when the magnesium-silicon compound is distributed in the form of fine particles in the aluminum alloy, since the magnesium-silicon compound is an intermetallic compound and has a higher strength than aluminum that is the matrix, the strength of the aluminum alloy can be increased due to dispersive distribution of such a high strength material.

Hereinafter, in order to help understanding of the present disclosure, experimental examples are provided. It will be understood that the following experimental examples are not provided to limit the present disclosure but are only provided to help the understanding of the present disclosure.

An experimental example is an aluminum alloy which is produced by adding a magnesium mother alloy including a magnesium-silicon compound according to the producing method of the present disclosure, whereas a comparative example is an aluminum alloy which is produced by adding only magnesium. Both of the experimental example and comparative example were produced through casting in a mold having a billet shape. At this time, the experimental example was produced by adding 5 wt % of magnesium mother alloy to pure aluminum, in which the magnesium mother alloy was produced by adding 0.5 wt % of silicon oxide as a silicon-based additive to pure magnesium. The comparative example was produced by adding 5 wt % of pure magnesium to pure aluminum.

Figure 5:
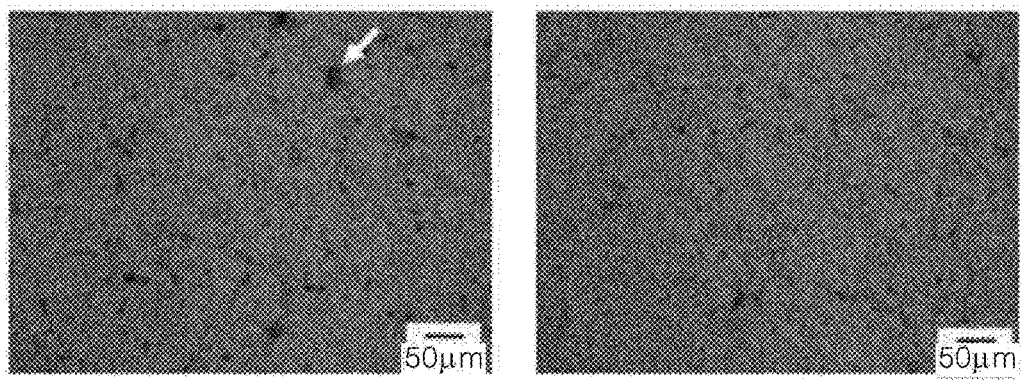
FIGS. 5A and 5B show results when microstructures of an experimental example in accordance with an exemplary embodiment, and a comparative example are observed by an optical microscope.

FIGS. 5A and 5B show results of microstructure when the experimental example and the comparative example were observed by an optical microscope. Referring to FIGS. 5A and 5B, it can be known that in the experimental example, particle phases (arrow) of magnesium-silicon compound are distributed in the matrix.

Figure 6:
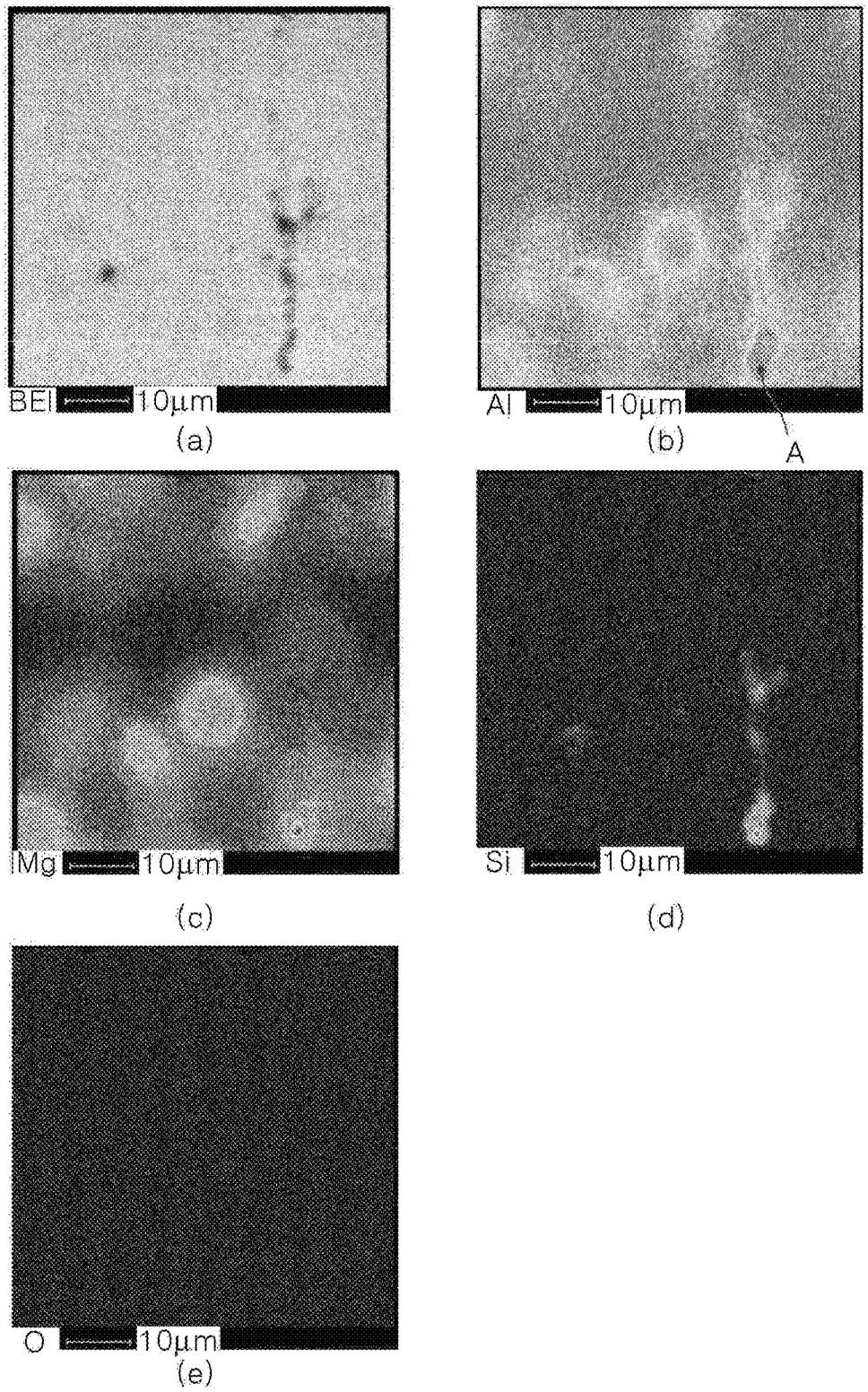
FIGS. 6A through 6D show analysis results of components and forms of magnesium-silicon compounds of experimental examples.

FIGS. 6A to 6E show detailed analysis results of the magnesium-silicon compound. FIG. 6A shows a microstructure of an aluminum alloy observed using a back scattering electron, and FIGS. 6B to 6E are mapping results by EPMA, and show distributions of aluminum, magnesium, silicon, and oxygen, respectively.

Region A of FIG. 6B is a region where an aluminum detection signal is very low, i.e., where aluminum component does not substantially exist. Referring to FIGS. 6C and 6D, it can be known that detection signals of magnesium and silicon are very high at the same region as region A of FIG. 6B, whereas oxygen was not detected at all, as shown in FIG. 6E.

From the observations, it can be confirmed that although a separate heat treatment is not performed in a cast state, the magnesium-silicon compound is distributed in the matrix of the aluminum alloy cast according to the present disclosure.

Table 1 shows average hardness values of the experimental example and the comparative example. The average hardness values were obtained by measuring hardness of two to six points on a surface of a cast billet using Rockwell Hardness Tester and Brinell Hardness Tester and averaging the measured values. Referring to Table 1, it can be known that the hardness of the experimental example is higher than that of the comparative example when the hardness was measured using Rockwell Hardness Tester and Brinell Hardness Tester.

TABLE 1

| Hardness Tester | Experimental Example | Comparative Example |
|---|---|---|
| Rockwell | 64 | 62.1 |
| Brinell | 58.65 | 56.83 |

From this result, it can be confirmed that the experimental example in which the magnesium-silicon compound exists in the matrix shows more excellent hardness than the comparative example.

By the method of producing an aluminum alloy according to the present disclosure, although a heat treatment is not performed, a magnesium-silicon compound included in a magnesium mother alloy added in the producing of the aluminum alloy is distributed in a matrix of the aluminum alloy. Therefore, since the magnesium-silicon compound may be distributed in the matrix without a separate heat treatment in a subsequent process after casting is completed, thus remarkably enhancing the mechanical characteristics, an epoch-making improvement in economic feasibility and productivity can be achieved.

The effects of the present disclosure are not limited to the above descriptions, and other effects that are not mentioned will be apparently understood to those skilled in the art from the following descriptions.

The descriptions for the specific embodiments of the present disclosure are provided for the purpose of illustration and explanation. Therefore, it will be understood by those of ordinary skill in the art that various modifications and changes, such as combinations of the embodiments may be made therein without departing from the technical spirits and scope of the present invention.

What is claimed is:

1. A method of producing an aluminum alloy, comprising:
melting a magnesium mother alloy including a magnesium-silicon compound, and aluminum to form a molten metal; and
casting the molten metal,
wherein the magnesium mother alloy is produced by adding a silicon oxide ($SiO_2$) to a mother material that is pure magnesium or a magnesium mother material,
wherein the magnesium mother alloy is added in a range of 0.0001 wt % to 30 wt %,
the silicon oxide is added in a range of 0.001 wt % to 30 wt %.

2. The method of claim 1, wherein the magnesium-silicon compound is produced by a reaction between magnesium and silicon separated from the silicon oxide.

3. The method of claim 2, wherein the producing of the magnesium mother alloy comprises:
melting pure magnesium or a magnesium alloy to form a magnesium molten metal; and
adding a the silicon oxide to the magnesium molten metal.

4. The method of claim 3, after the adding of the silicon oxide, further comprising:
exhausting the silicon oxide so as not to substantially remain in the magnesium mother alloy; and
reacting silicon produced as a result of the exhausting so as not to substantially remain in the magnesium mother alloy.

5. The method of claim 3, wherein the silicon oxide is added to be uniformly dispersed in a surface of the magnesium molten metal.

6. The method of claim 3, wherein the silicon oxide is added to a range that the silicon oxide reacts completely and does not remain in the magnesium mother alloy.

7. The method of claim 3, wherein after the adding of the silicon oxide, stirring of an upper layer portion of the magnesium molten metal is performed.

8. The method of claim 7, wherein the stirring is performed at an upper layer portion from a surface of the magnesium molten metal to a point which is not more than 20% of a total depth of the magnesium molten metal.

9. The method of claim 1, wherein the magnesium-silicon compound comprises $Mg_2Si$.

10. The method of claim 1, wherein the aluminum is pure aluminum or an aluminum alloy.

* * * * *